US010317827B2

(12) United States Patent
Sekiyama et al.

(10) Patent No.: US 10,317,827 B2
(45) Date of Patent: Jun. 11, 2019

(54) FIXING DEVICE FOR FORMING A NIP PORTION WITH A HEATER FOR IMAGE FORMING

(71) Applicant: CANON KABUSHIKI KAISHA, Tokyo (JP)

(72) Inventors: Junichi Sekiyama, Tokyo (JP); Ryo Iwasawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/013,733

(22) Filed: Jun. 20, 2018

(65) Prior Publication Data

US 2019/0004459 A1 Jan. 3, 2019

(30) Foreign Application Priority Data

Jun. 29, 2017 (JP) ..... 2017-128000

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
USPC ..... 399/330, 329
See application file for complete search history.

(56) References Cited

U.S. PATENT DOCUMENTS 7,366,455 B2 * 4/2008 Iwasaki ..... G03G 15/2042 219/216
9,513,586 B2 * 12/2016 Narahara ..... G03G 15/55
2006/0153605 A1 * 7/2006 Nishiyama ..... G03G 15/2042 399/329
2016/0098001 A1 * 4/2016 Ogawa ..... G03G 15/2053 399/338
2016/0246229 A1 * 8/2016 Taguchi ..... G03G 15/2053

FOREIGN PATENT DOCUMENTS

JP 2003-257592 A 9/2003

* cited by examiner

*Primary Examiner* — Quana Grainger
(74) *Attorney, Agent, or Firm* — Canon U.S.A., Inc. IP Division

(57) ABSTRACT

A fixing device includes a rotatable cylindrical film, an elongated plate-like heater, a heat conducting member, and a supporting member, wherein the heat conducting member includes an extension portion which extends along a direction opposite to a rotation direction of the film from a portion extending in a direction along a thickness surface of the heater perpendicular to the first surface outside an end portion at one side of the heater in the rotation direction of the film and which contacts the inner surface of the film, wherein the supporting member includes a facing portion which faces the extension portion in a thickness direction of the heater, and wherein a void space is provided between the extension portion of the heat conducting member and the facing portion of the supporting member.

9 Claims, 16 Drawing Sheets

FIXING DEVICE FOR FORMING A NIP PORTION WITH A HEATER FOR IMAGE FORMING

BACKGROUND OF THE INVENTION

Field of the Invention

Aspects of the present disclosure generally relate to a fixing device for use in an image forming apparatus, such as a copying machine or a laser beam printer, of the electrophotographic type.

Description of the Related Art

The following configuration is known as a fixing device for use in an image forming apparatus of the electrophotographic type. That configuration includes a cylindrical film, a heater which contacts the film, and a pressure roller which forms a nip portion in conjunction with the heater via the film. A recording material bearing an unfixed toner image thereon is heated at the nip portion while being conveyed, so that the toner image is fixed to the recording material.

Furthermore, if the film of the fixing device is rotated at high speed in such a way as to be compatible with high-speed printing, supplying of heat from the heater to the film may become too late. Therefore, a configuration capable of also transferring heat from the heater to the film via a portion other than a surface of the heater contacting the film is known (Japanese Patent Application Laid-Open No. 2003-257592). For a specific example of such a configuration, a heat conducting member (metallic plate) is brought into contact with a surface of the heater opposite to the surface thereof contacting the film and the heat conducting member is then brought into contact with the film. This configuration enables performing fixing processing at higher speed.

However, a portion of the heat conducting member extending to an upstream side in the recording material conveyance direction and contacting the film is also in contact with a heater holder, so that heat from the heat conducting member is likely to undesirably dissipate to the heater holder.

SUMMARY OF THE INVENTION

Aspects of the present disclosure are generally directed to providing a fixing device capable of efficiently transferring heat generated by a heater to a film via a heat conducting member contacting the heater.

According to an aspect of the present disclosure, a fixing device that heats a toner image to fix the toner image to a recording material includes a rotatable cylindrical film, an elongated plate-like heater which has a first surface and a second surface opposite to the first surface and which contacts an inner surface of the film with the first surface, a heat conducting member which extends in a longitudinal direction of the heater and which includes a heater contact portion contacting the second surface of the heater, and a supporting member which supports the second surface of the heater via the heat conducting member, wherein the heat conducting member includes an extension portion which extends along a direction opposite to a rotation direction of the film from a portion extending in a direction along a thickness surface of the heater perpendicular to the first surface outside an end portion at one side of the heater in the rotation direction of the film and which contacts the inner surface of the film, wherein the supporting member includes a facing portion which faces the extension portion in a thickness direction of the heater, and wherein a void space is provided between the extension portion of the heat conducting member and the facing portion of the supporting member.

Further features of the present disclosure will become apparent from the following description of exemplary embodiments with reference to the attached drawings.

DESCRIPTION OF THE EMBODIMENTS

A first exemplary embodiment of the present disclosure is described below with reference to the drawings.

Figure 1:
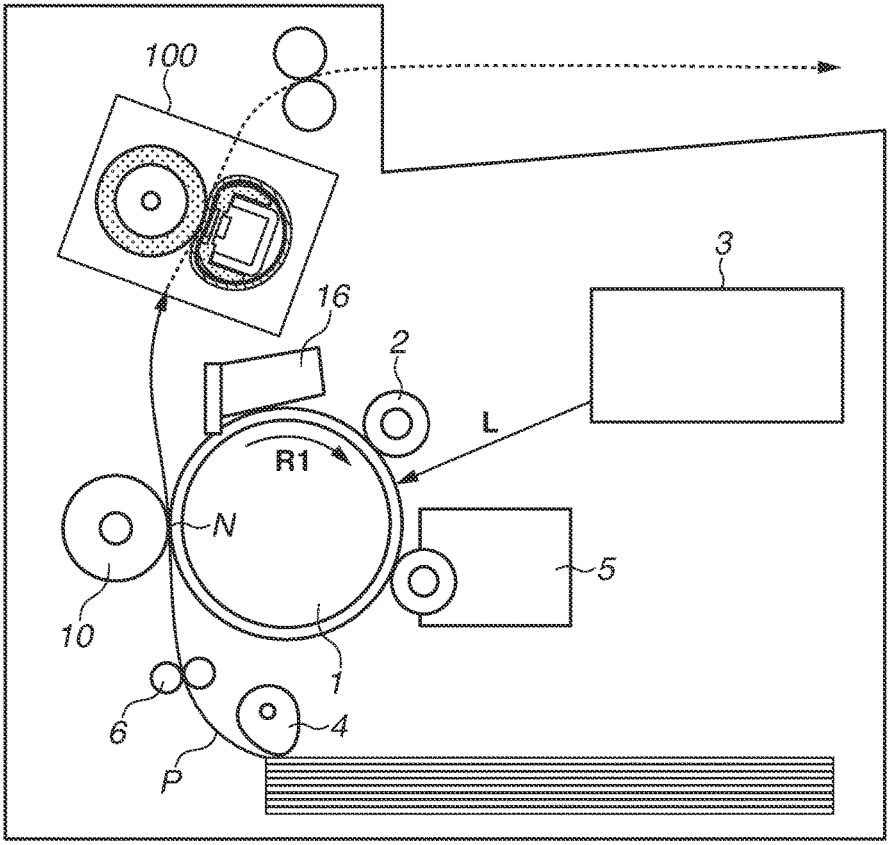
FIG. 1 is a schematic sectional view of an image forming apparatus according to a first exemplary embodiment.

First, a configuration of an image forming apparatus according to the present exemplary embodiment is described with reference to FIG. 1. FIG. 1 is a schematic sectional view of a laser beam printer 50 serving as an image forming apparatus of the electrophotographic type according to the present exemplary embodiment.

A charging device 2, an exposure device 3, which irradiates a photosensitive drum 1 serving as an image bearing member with laser light L, a developing device 5, a transfer roller 10, and a photosensitive drum cleaner 16 are located on the circumferential surface of the photosensitive drum 1 in sequence along the rotation direction thereof (the direction of arrow R1). First, with regard to the photosensitive drum 1, the surface thereof is charged with minus polarity by the charging device 2. Next, with regard to the charged photosensitive drum 1, an electrostatic latent image is formed on the surface of the photosensitive drum 1 by the laser light L radiated from the exposure device 3 (the surface potential of an exposed portion increasing). Since toner for use in the present exemplary embodiment is charged with minus polarity, minus-charged toner adheres to only an electrostatic latent image portion on the photosensitive drum 1 by the developing device 5, in which black toner is contained, so that a toner image is formed on the photosensitive drum 1. When a recording material P is fed by a feed roller 4, the recording material P is conveyed to a transfer nip portion N by a conveyance roller 6. A transfer bias with plus polarity, which is a polarity reverse to the polarity of toner, is applied from a power supply (not illustrated) to the transfer roller 10, so that the toner image on the photosensitive drum 1 is transferred to the recording material P at the transfer nip portion N. With regard to the photosensitive drum 1 after transfer is performed, untransferred toner remaining on the surface of the photosensitive drum 1 is removed by the photosensitive drum cleaner 16, which includes an elastic member blade. The recording material P bearing the toner image thereon is conveyed to a fixing device 100, in which heat fixing of the toner image on the surface of the recording material P is performed.

Figure 2:
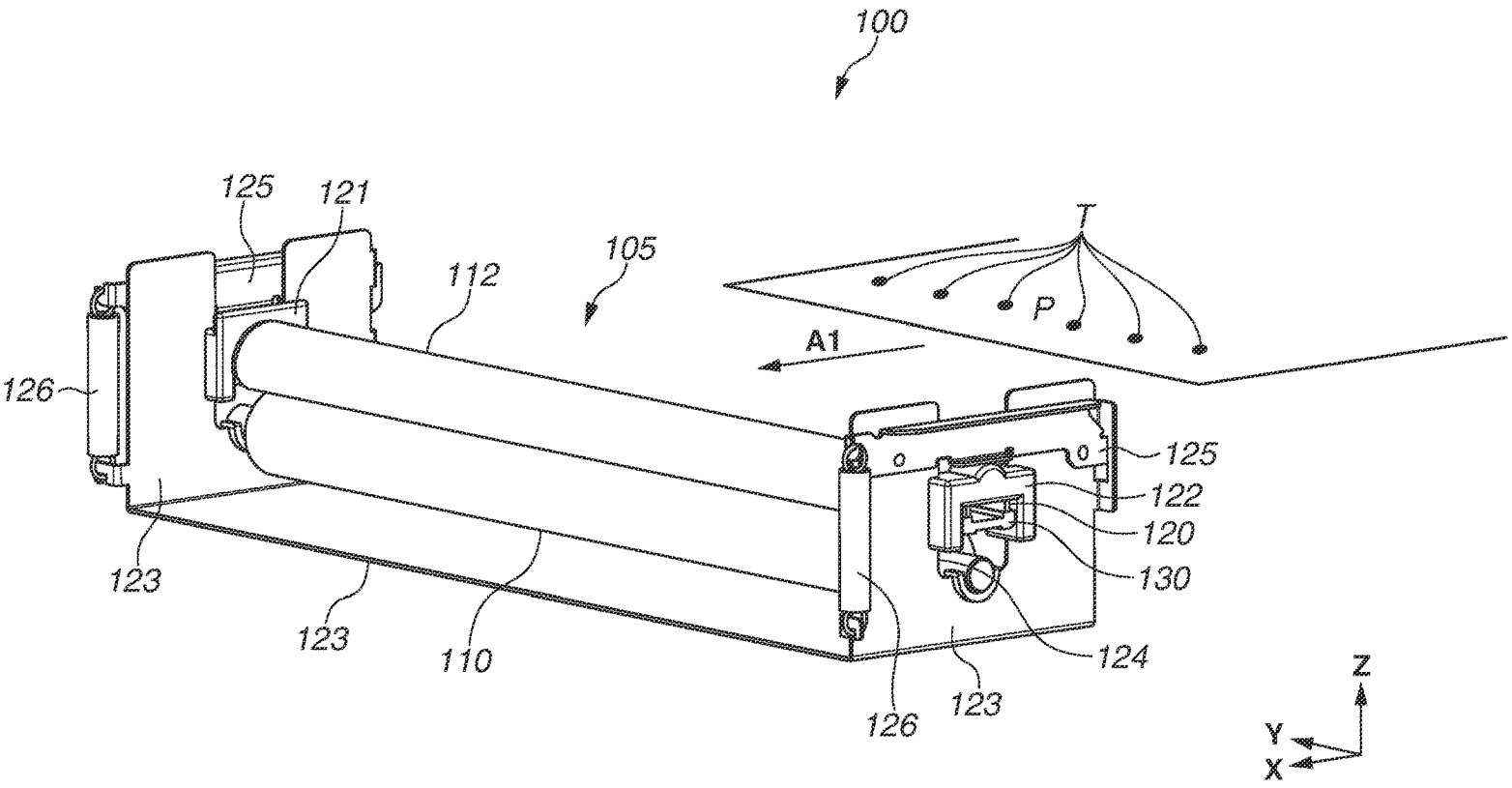
FIG. 2 is a perspective view of a fixing device according to the first exemplary embodiment.
Figure 3:
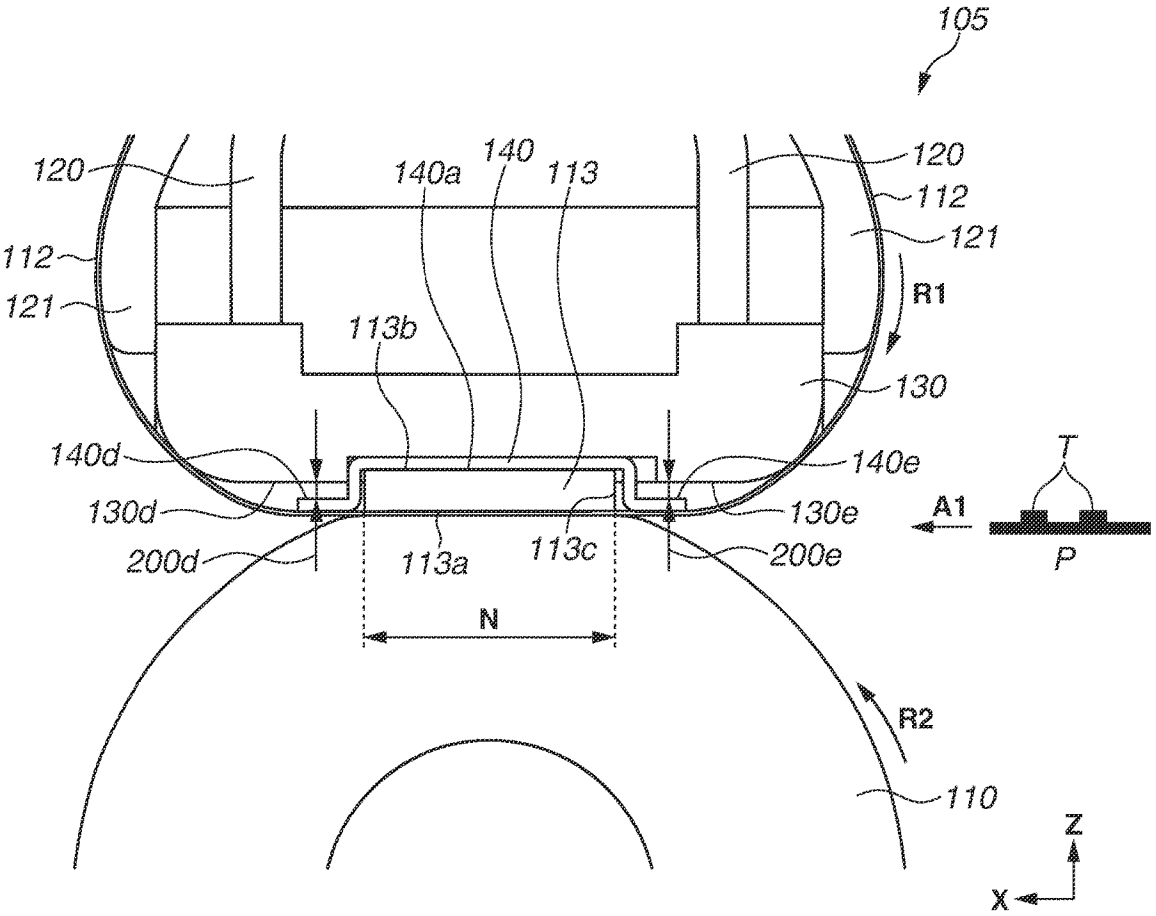
FIG. 3 is a sectional view of the fixing device according to the first exemplary embodiment.

Next, the fixing device 100 according to the present exemplary embodiment is described with reference to FIG. 2 and FIG. 3. FIG. 2 and FIG. 3 are a perspective view and a sectional view of the fixing device 100 according to the present exemplary embodiment, respectively. The fixing device 100 according to the present exemplary embodiment employs a film heating method, which can achieve shortening of a warming-up time and saving of energy.

The fixing device 100 includes a cylindrical fixing film 112, a heater 113, a pressure roller 110, and a heat conducting member 140. The heater 113 contacts the inner surface of the fixing film 112 to form a nip portion N in conjunction with the pressure roller 110. The recording material P having a toner image formed thereon is heated while being conveyed at the nip portion N, so that the toner image is fixed to the recording material P.

Here, the conveyance direction of the recording material P at the nip portion N is defined as the X-axis direction, the longitudinal direction of the heater 113 is defined as the Y-axis direction, and the direction of pressure at the nip portion N is defined as the Z-axis direction.

The fixing film 112, the heater 113, and the heat conducting member 140 are unitized as a film unit 105. The film unit 105 further includes a heater holder 130 serving as a supporting member, a reinforcement stay 120 serving as a reinforcement member, and flanges R121 and L122 serving as a regulating member. The heater holder 130 is a member used to support the heater 113. The reinforcement stay 120 is a member used to reinforce the heater holder 130. The flanges R121 and L122 are members used to regulate the movement of the fixing film 112 in the Y-axis direction (the longitudinal direction of the heater 113), and are located at positions opposite to both longitudinal end portions of the fixing film 112.

The film unit 105 is mounted to a fixing frame 123, at which both end portions of the pressure roller 110 are supported in such a way as to be rotatable. Sliding the film unit 105 along groove portions 124 of the fixing frame 123 is employed to mount the film unit 105 to the fixing frame 123. The film unit 105 is pressed against the pressure roller 110 by pressure plates 125 and pressure springs 126. With regard to a pressure configuration, the pressure force exerted by the pressure springs 126 is transmitted to the pressure plates 125, the flanges R121 and L122, the reinforcement stay 120, the heater holder 130, the heat conducting member 140, and the heater 113 in sequence. Then, the heater 113 is pressed against the pressure roller 110 via the fixing film 112, so that the nip portion N is formed.

Here, in FIG. 3, a surface of the heater 113 contacting the fixing film 112 is referred to as a "first surface 113*a*", and a surface of the heater 113 opposite to the first surface 113*a* is referred to as a "second surface 113*b*".

The heat conducting member 140 is provided in such a way as to contact the second surface 113*b* of the heater 113 and to be sandwiched between the heater 113 and the heater holder 130. The heater 113 is supported by the heater holder 130 via the heat conducting member 140.

The heater holder 130 is provided with arc-like guide portions in such a way as to allow the fixing film 112 to smoothly rotate. This allows the fixing film 112 to smoothly rotate in the direction of arrow R1 according to the rotation of the pressure roller 110 in the direction of arrow R2. The first surface 113*a* of the heater 113 is in sliding contact with the inner surface of the fixing film 112 and is used to heat the fixing film 112 from the inside thereof. The pressure roller 110 presses the heater 113 from the outside of the fixing film 112. The nip portion N is a region in which the pressure roller 110 and the fixing film 112 are in contact with each other. When the recording material P having an unfixed toner image T formed thereon is conveyed to the nip portion N from the direction of arrow A1 in FIG. 3, the toner image T is fixed to the recording material P.

The fixing film 112 is described here. The fixing film 112 is configured to be rotatable, and has a cylindrical shape with an outer diameter ϕ of 18 mm taken when no external force is applied thereto. The fixing film 112 has a multi-layer structure as viewed in the thickness direction thereof. The fixing film 112 includes a base layer and a release layer, which is formed on the outer side of the base layer. The material of the base layer to be used includes, in view of heat resistance and stiffness, metal, such as stainless steel or nickel, and heat resistant resin, such as polyimide. In the present exemplary embodiment, a polyimide resin is used as the material of the base layer of the fixing film 112, and a carbon-based filler is added thereto to increase heat conductivity and strength. Since the thinner the thickness of the base layer, the more likely the base layer is to transmit heat of the heater 113 to the surface of the fixing film 112 but the lower the strength of the base layer becomes, it is desirable that the thickness of the base layer be about 15 μm to 100 μm, and, in the present exemplary embodiment, the thickness of the base layer is set to 50 μm. The desirable material of the release layer includes fluorine resin, such as perfluoroalkoxy alkane resin (PFA), polytetrafluoroethylene resin (PTFE), and tetrafluoroethylene-hexafluoropropylene (fluorinated ethylene propylene) resin (FEP). In the present exemplary embodiment, PFA, which excels in releasability and heat resistance among fluorine resins, is used. The release layer can be a layer covered with a tube or a layer coated with paint, and, in the present exemplary embodiment, the release layer is molded with a coat excellent in thin-wall molding. Since the thinner the thickness of the release layer, the more likely the release layer is to transmit heat of the heater 113 to the surface of the fixing film 112 but the lower the durability of the release layer becomes, it is desirable that the thickness of the release layer be about 5 μm to 30 μm, and, in the present exemplary embodiment, the thickness of the release layer is set to 10 μm. Furthermore, although not being used in the present exemplary embodiment, an elastic layer can be provided between the base layer and the release layer. In that case, for example, silicone rubber or fluorine-contained rubber is used as the material of the elastic layer.

The pressure roller 110 is described here. The outer diameter ϕ of the pressure roller 110 is 20 mm, and the pressure roller 110 is formed of a core metal with a diameter ϕ of 12 mm and an elastic layer with a thickness of 4 mm. Solid rubber or foamed rubber is used as the material of the elastic layer. Since foamed rubber has a low heat capacity and is low in heat conductivity and heat of the surface of the pressure roller 110 is unlikely to be absorbed into the inside thereof, foamed rubber has such an advantage that the surface temperature is likely to rise and the rise time can be shortened. In the present exemplary embodiment, foamed rubber formed by foaming silicone rubber is used. Since the smaller the outside diameter of the pressure roller 110, the lower the heat capacity becomes but the narrower the width of the nip portion N becomes, an appropriate outer diameter of the pressure roller 110 is required, and, in the present exemplary embodiment, the outer diameter ϕ is set to 20 mm. Even with regard to the wall thickness of the elastic layer, since, if the elastic layer is too thin, heat dissipates to the core metal made of metal, an appropriate thickness of the release layer is required, and, in the present exemplary embodiment, the thickness of the release layer is set to 4 mm. On the elastic layer, a release layer, which is made from perfluoroalkoxy alkane resin (PFA), is formed as a release layer for toner. While the release layer can be a layer covered with a tube or a layer coated with paint as with the release layer of the fixing film 112, in the present exemplary embodiment, a tube, which is excellent in durability, is used. The material of the release layer to be used includes, in addition to PFA, for example, fluorine contained resin, such as PTFE or FEP, and fluorine-contained rubber and silicone rubber, which are excellent in releasability. The lower the surface hardness of the pressure roller 110, the wider the width of the nip portion N becomes. In the present exemplary embodiment, to verify a relationship between a variation of the width of the nip portion N and the heat conduction related to the heat conducting member 140, which is described below, pressure rollers with three levels of Asker-C hardness (4.9 N load) of 48°, 50°, and 52° are used. The outer diameter ϕ of the pressure roller 110 in the present exemplary embodiment is 20 mm, and the pressure roller 110 is formed of a core metal with a diameter ϕ of 12 mm and an elastic layer with a thickness of 4 mm. Solid rubber or foamed rubber is used as the material of the elastic layer. Since foamed rubber has a low heat capacity and is low in heat conductivity and heat of the surface of the pressure roller 110 is unlikely to be absorbed into the inside thereof, foamed rubber has such an advantage that the surface temperature is likely to rise and the rise time can be shortened. In the present exemplary embodiment, foamed rubber formed by foaming silicone rubber is used. The pressure roller 110 is pressed against the heater 113 by a pressure unit (not illustrated). Even with regard to a pressure force, to verify a relationship between a variation of the width of the nip portion N and the heat conduction of the heat conducting member 140, which is described below, three levels of the total pressure of 13 kgf, 14 kgf, and 15 kgf are used. The pressure roller 110 is configured to be rotated by a rotation unit (not illustrated) at a surface movement speed of 200 mm/sec in the direction of arrow R2 in FIG. 3.

The heater 113 is described here. The heater 113 is configured with a heat generation resistor provided on a substrate made from ceramic, such as alumina or aluminum nitride. The heater 113 is a plate-like elongated member having a first surface 113*a*, which contacts the inner surface of the fixing film 112, a second surface 113*b*, which is a surface opposite to the first surface 113*a*, and a third surface (thickness surface) 113*c*, which is perpendicular to the first surface 113*a*. The heater 113 has a thin shape extending in the X-axis direction described above. The heater 113 to be used is formed by coating the surface of a substrate made from alumina of 6 mm in width in the recording material conveyance direction and 1 mm in thickness with a heat generation resistor made from silver-palladium (Ag/Pd) as much as 10 μm by screen printing and, then, covering the heat generation resistor with a glass of 50 μm in thickness as a heat generator protection layer. Moreover, electric power to be supplied to the heat generation resistor of the heater 113 is controlled according to a signal output from a temperature detection element (not illustrated), which detects the temperature of the heater 113 or the fixing film 112.

The heat conducting member 140 is described here. The heat conducting member 140 includes a heater contact portion 140*a*, which is a portion that contacts the second surface 113*b* of the heater 113. The heat conducting member 140 further includes an upstream-side extension portion 140*e* which extends along a direction opposite to the rotation direction of the fixing film 112 from a portion extending in a direction along the thickness surface of the heater 113 outside an end portion at the upstream side of the heater 113 in the rotation direction of the fixing film 112 from the heater contact portion 140*a*. The heat conducting member 140 further includes a downstream-side extension portion 140*d* which extends along the rotation direction of the fixing film 112 from a portion extending along the third surface 113*c* of the heater 113 outside an end portion at the downstream side of the heater 113 in the rotation direction of the fixing film 112 from the heater contact portion 140*a*. The upstream-side extension portion 140*e* and the downstream-side extension portion 140*d* of the heat conducting member 140 are in contact with the inner surface of the fixing film 112 at the upstream side and the downstream side, respectively, of the heater 113 in the rotation direction of the fixing film 112.

The heat conducting member 140 functions to transfer heat received from the heater 113 at the heater contact portion 140*a* to the fixing film 112 at the upstream-side extension portion 140*e* and the downstream-side extension portion 140*d*. It is desirable that the heat conducting member 140 be a member having a heat conductivity of 100 W/m·K or more. In the present exemplary embodiment, an aluminum alloy with a heat conductivity of 140 W/m·K is used. It is desirable that the heat conductivity of the heat conducting member 140 be higher than that of the substrate made from ceramic, such as alumina or aluminum nitride, of the heater 113.

The heater holder 130, which is a feature of the present exemplary embodiment, is described here. The heater holder 130 is a supporting member which supports the second surface 113*b* of the heater 113. The heater holder 130 is formed of, for example, a liquid crystalline polymer, which is a heat resistant resin. Portions of the heater holder 130 facing the upstream-side extension portion 140*e* and the downstream-side extension portion 140*d* of the heat conducting member 140 are respectively referred to as an "upstream-side facing portion 130*e*" and a "downstream-side facing portion 130*d*".

A characteristic configuration in the present exemplary embodiment is described here. A void space 200*e* of 0.3 mm is provided between the upstream-side extension portion 140*e* of the heat conducting member 140 and the upstream-side facing portion 130*e* of the heater holder 130. Moreover, a void space 200*d* of 0.3 mm is provided between the downstream-side extension portion 140*d* of the heat conducting member 140 and the downstream-side facing portion 130*d* of the heater holder 130.

These void spaces 200*d* and 200*e* enable preventing heat of the heat conducting member 140 from dissipating to the heater holder 130. Accordingly, such an advantageous effect that the heat of the heater 113 is able to be efficiently transferred to the fixing film 112 via the heat conducting member 140 can be achieved.

Furthermore, in the present exemplary embodiment, the position of the heat conducting member 140 in the thickness direction of the heater 113 (in a direction from the second surface 113*b* toward the first surface 113*a*) is determined by the surface of the heat conducting member 140 opposite to the heater contact portion 140*a* contacting the surface of the heater holder 130 facing the opposite surface.

Figure 4:
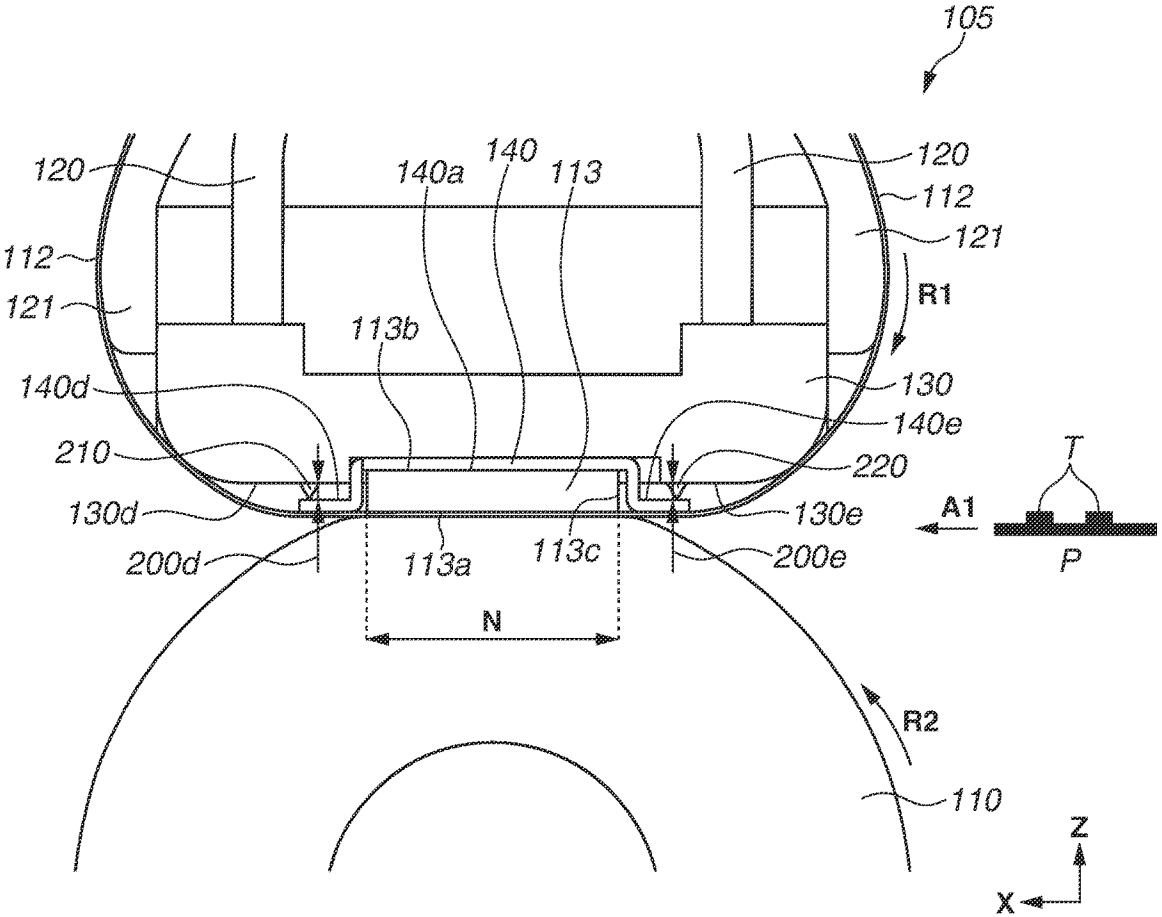
FIG. 4 is a sectional view of a fixing device according to a second exemplary embodiment.
Figure 5:
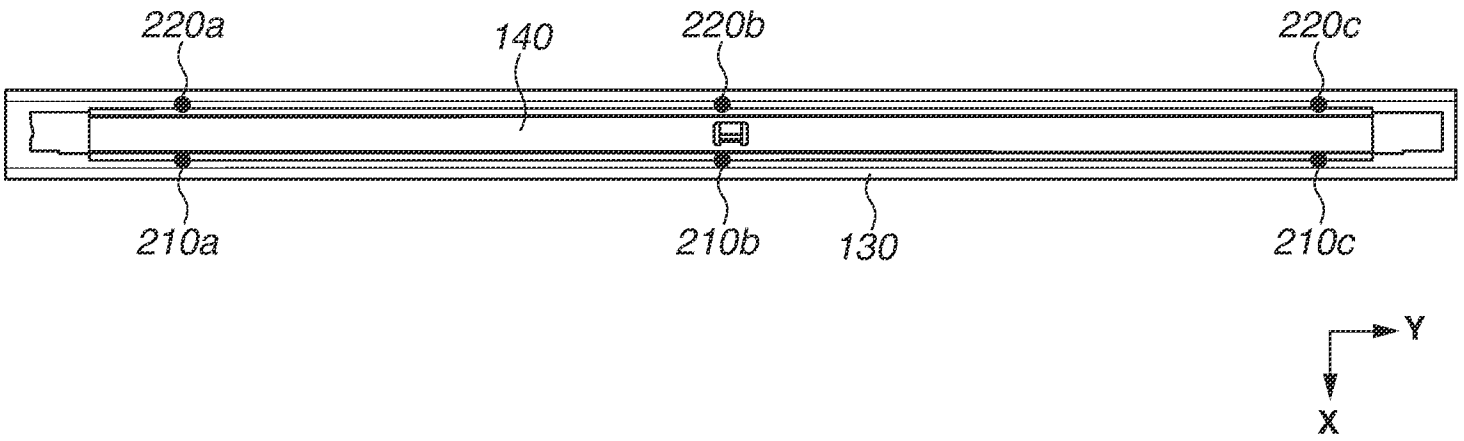
FIG. 5 is a plan view of a heater holder and a heat conducting member according to the second exemplary embodiment.

A second exemplary embodiment of the present disclosure is described with reference to FIG. 4 and FIG. 5. The present exemplary embodiment differs from the first exemplary embodiment only in that the heater holder 130 has protruded portions 210 and 220. The other configurations are similar to those of the first exemplary embodiment, and are, therefore, omitted from description.

A feature of the present exemplary embodiment is described with reference to FIG. 4. The upstream-side facing portion 130*e* and the downstream-side facing portion 130*d* of the heater holder 130 are respectively provided with the protruded portions 220 and 210, which are configured to protrude toward the upstream-side extension portion 140*e* and the downstream-side extension portion 140*d* of the heat conducting member 140. The protruded portions 220 and 210 are in contact with the upstream-side extension portion 140*e* and the downstream-side extension portion 140*d* of the heat conducting member 140, respectively. In order for such a contact area to be as small as possible, each of the protruded portions 220 and 210 has a conical shape. The shape of each of the protruded portions 220 and 210 is not limited to this, but can be a columnar rib. Each of the protruded portions 220 and 210 includes three portions provided at a middle position in the longitudinal direction and two end portions in the longitudinal direction of the heater holder 130 (portions 210*a*, 210*b*, 210*c*, 220*a*, 220*b*, and 220*c*), as illustrated in FIG. 5.

An advantageous effect of the protruded portions 220 and 210 is described. When the upstream-side extension portion 140*e* and the downstream-side extension portion 140*d* receive an external force from, for example, the fixing film 112, those are prevented from deforming in a direction to move away from the inner surface of the fixing film 112, so that the void spaces 200*d* and 200*e* can be stably ensured in an advantageous manner. The void spaces 200*d* and 200*e* function as a heat-insulating layer.

Furthermore, each of the protruded portions 220 and 210 can be configured with an elastic member. Moreover, in a state in which no external force is applied to the upstream-side extension portion 140*e* and the downstream-side extension portion 140*d* of the heat conducting member 140, the protruded portions 220 and 210 and the upstream-side extension portion 140*e* and the downstream-side extension portion 140*d* can be configured to be in non-contact with each other. When the upstream-side extension portion 140*e* and the downstream-side extension portion 140*d* receive an external force from, for example, the fixing film 112 and deform by a predetermined amount, those contact the protruded portions 220 and 210 and are thus prevented from deforming any further. This is because a configuration in which the position of the heat conducting member 140 in the pressing direction is determined only by a contact between the surface of the heat conducting member 140 opposite to the heater contact portion 140*a* and the surface of the heater holder 130 facing the opposite surface is more likely to improve the positional accuracy. Furthermore, the pressing direction is a direction from the second surface 113*b* toward the first surface 113*a*.

Moreover, in the present exemplary embodiment, the protruded portions 220 and 210 are provided at the heater holder 130, but can be provided at the heat conducting member 140 to achieve a similar advantageous effect.

In a third exemplary embodiment of the present disclosure, members similar to those of the first exemplary embodiment are omitted from description, and different members are described.

Figure 6:
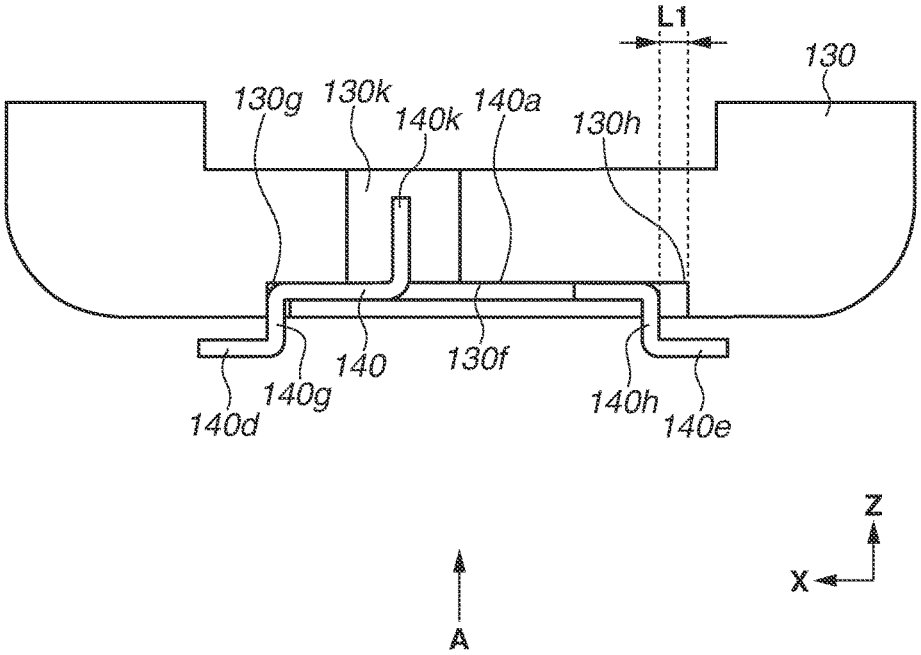
FIG. 6 is a sectional view of a heater holder and a heat conducting member according to a third exemplary embodiment.

A positioning configuration of the heat conducting member 140 relative to the heater holder 130 is described with reference to FIG. 6 to FIGS. 8A, 8B, and 8C. First, a positioning configuration concerning two components, i.e., the heat conducting member 140 and the heater holder 130, in the X-axis direction (along the rotation direction of the fixing film 112) is described. FIG. 6 is a sectional view taken perpendicular to the heater 113, illustrating only the above-mentioned two components. The heat conducting member 140 is provided in such a manner that a part of the heat conducting member 140 is fitted between a wall surface 130*g* at the downstream side and a wall surface 130*h* at the upstream side in the recording material conveyance direction of a groove portion provided along the longitudinal direction of the heater holder 130. Here, a portion located between the heater contact portion 140*a* and the downstream-side extension portion 140*d* of the heat conducting member 140 and extending along the third surface 113*c* of the heater 113 is referred to as a "bent portion 140*g*". The position of the heat conducting member 140 relative to the heater holder 130 in the X-axis direction is determined by the wall surface 130*g* of the heater holder 130 and the bent portion 140*g* of the heat conducting member 140 contacting each other. Here, a portion located between the heater contact portion 140*a* and the upstream-side extension portion 140*e* of the heat conducting member 140 and extending along the −Z-axis direction (along the third surface 113*c* of the heater 113) is referred to as a "bent portion 140*h*". A clearance L1 is provided between the bent portion 140*h* of the heat conducting member 140 and the wall surface 130*h* of the heater holder 130, so that a void space is formed.

Furthermore, a configuration in which the bent portion 140*h* of the heat conducting member 140 and the wall surface 130*h* of the heater holder 130 are in contact with each other and a gap is provided between the bent portion 140*g* and the wall surface 130*g* can be employed. Moreover, a configuration in which clearances are respectively provided between the bent portion 140*g* and the wall surface 130*g* and between the bent portion 140*h* and the wall surface 130*h* so that void spaces are formed can be employed.

Next, positioning of the heat conducting member 140 relative to the heater holder 130 with respect to the Z-axis direction (the thickness direction of the heater 113) is described. As mentioned above, the film unit 105 is pressed against the pressure roller 110 by the pressure plates 125 and the pressure springs 126, which serve as a pressure unit. With this, positioning is performed in such a manner that a surface of the heater contact portion 140*a* of the heat conducting member 140 facing the heater holder 130 contacts a supporting surface 130*f* of the groove provided on the heater holder 130.

Figure 7A:
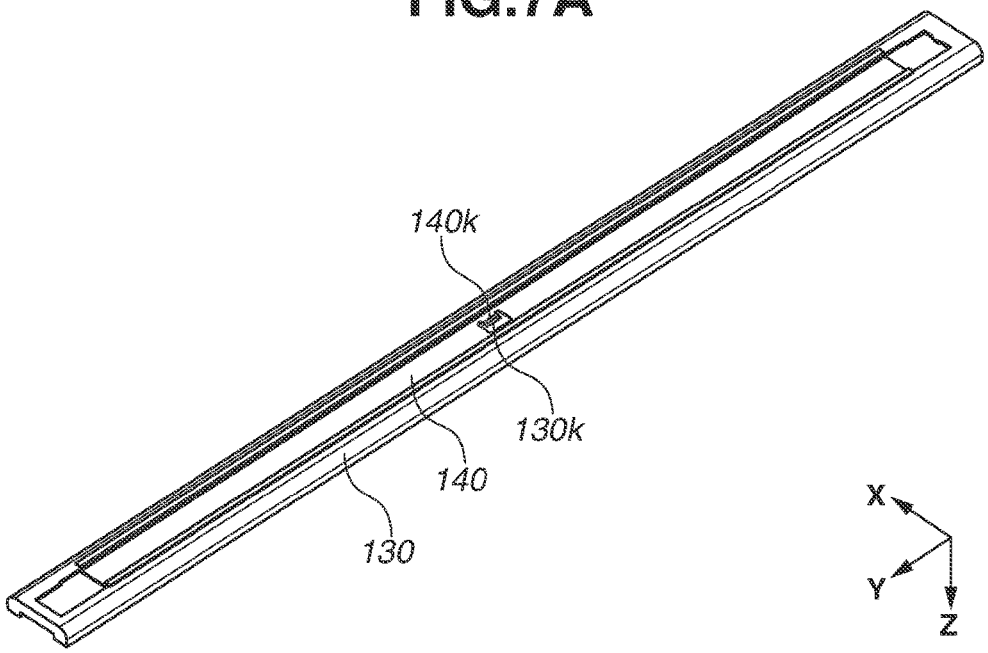
FIGS. 7A and 7B are perspective views of the heater holder and the heat conducting member according to the third exemplary embodiment.
Figure 7B:
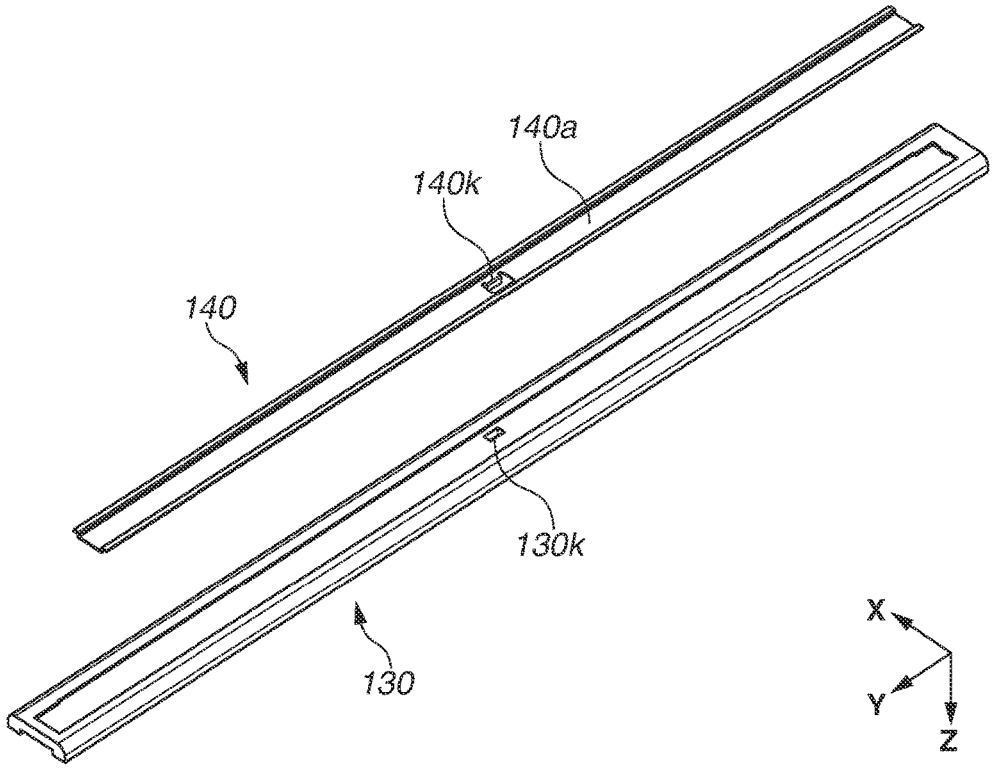
Figure 8A:
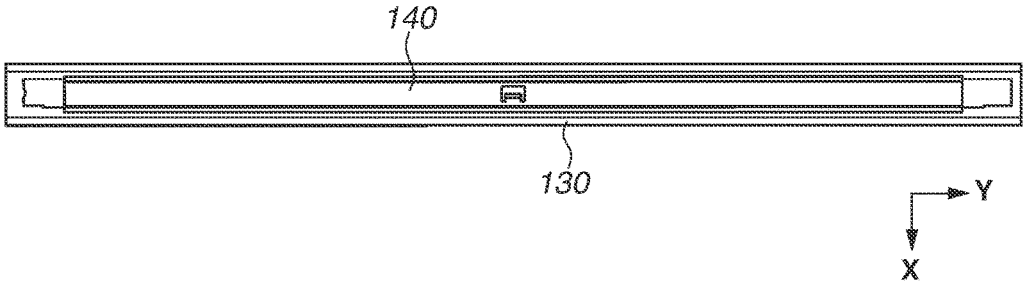
FIGS. 8A, 8B, and 8C are diagrams as viewed from the direction of arrow A illustrated in FIG. 6 in the third exemplary embodiment.
Figure 8B:
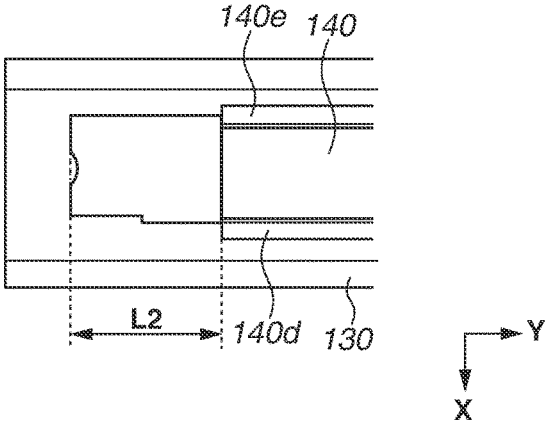
Figure 8C:
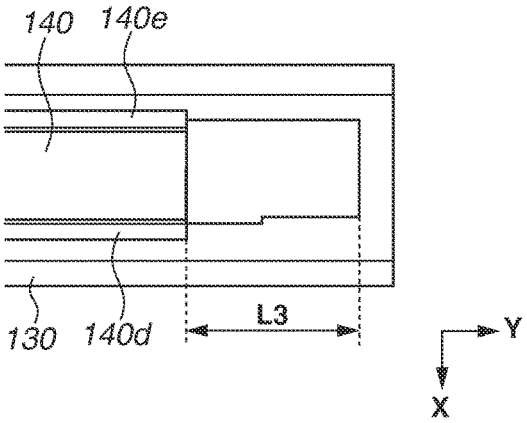

Next, positioning of the heat conducting member 140 relative to the heater holder 130 with respect to the Y-axis direction (the longitudinal direction of the heater 113) is described with reference to FIGS. 7A and 7B and FIGS. 8A, 8B, and 8C. FIG. 7A is a perspective view of the above-mentioned two components, and FIG. 7B is a perspective view illustrating the above-mentioned two components in a vertically separate manner for convenience sake. FIG. 8A is a diagram as viewed from the direction of arrow A in FIG. 6, and FIGS. 8B and 8C are enlarged views of respective portions near both longitudinal end portions in FIG. 8A.

As illustrated in FIGS. 7A and 7B, a bent portion 140*k* of the heat conducting member 140 is inserted into a hole portion 130*k* provided on the heater holder 130 in such a manner that the bent portion 140*k* engages with the hole portion 130*k*, so that the position of the heat conducting member 140 relative to the heater holder 130 in the longitudinal direction is determined. In this instance, the bent portion 140*k* provided on the heat conducting member 140 is formed by bending and raising a part of the heater contact portion 140*a* in a direction to come close to the heater holder 130. Moreover, as illustrated in FIG. 8B, a clearance L2 is provided between one longitudinal end portion of the heat conducting member 140 and one longitudinal end surface of the groove portion of the heater holder 130 facing each other. Furthermore, as illustrated in FIG. 8C, a clearance L3 is provided between the other longitudinal end portion of the heat conducting member 140 and the other longitudinal end surface of the groove portion of the heater holder 130 facing each other.

Here, the reason why the clearances L2 and L3 are provided is described. The heat conducting member 140, which is formed of pure aluminum or an aluminum alloy, and the heater holder 130, which is formed of high-temperature resin such as a liquid crystalline polymer, differ from each other in linear expansion coefficient. Accordingly, the amount of expansion in the longitudinal direction of the heat conducting member 140 is larger than that of the heater holder 130. The above-mentioned clearances L2 and L3 are set in consideration of the amount of expansion of each component and the dimensional tolerance of each component.

Next, a positioning configuration of the heater 113 relative to the heater holder 130 is described with reference to FIG. 9 and FIGS. 10A, 10B, and 10C.

Figure 9:
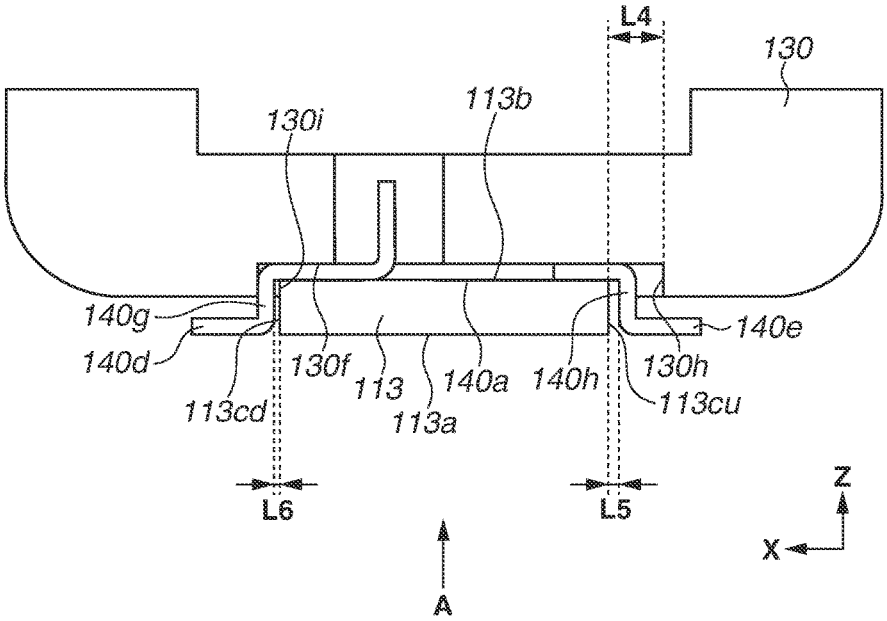
FIG. 9 is a sectional view of a heater, the heater holder, and the heat conducting member according to the third exemplary embodiment.

Positioning of the above-mentioned two components with respect to the Y-axis direction (the longitudinal direction of the heater 113) is described with reference to FIG. 9. FIG. 9 is a sectional view illustrating the heat conducting member 140 as well as the above-mentioned two components. The heater 113 is mounted in such a manner that a contact surface 130*i* provided on the heater holder 130 contacts a surface 113*cd* at the downstream side in the rotation direction of the fixing film 112 of the third surfaces 113*c* of the heater 113. In this instance, a clearance L4 is provided between a surface 113*cu* at the upstream side in the rotation direction of the fixing film 112 of the third surfaces 113*c* of the heater 113 and a wall surface 130*h* of the heater holder 130 facing each other, so that a void space is formed.

In this instance, even with regard to a positional relationship between the heater 113 and the heat conducting member 140, positioning of them relative to each other is performed via the heater holder 130. In the present exemplary embodiment, a clearance L5 is provided between the third surface 113*cu* of the heater 113 and the bent portion 140*h* provided between the heater contact portion 140*a* and the upstream-side extension portion 140*e*. A clearance L6 is provided between the third surface 113*cd* of the heater 113 and the bent portion 140*g* provided between the heater contact portion 140*a* and the downstream-side extension portion 140*d*.

Next, positioning of the heater 113 relative to the heater holder 130 in the Z-axis direction (the thickness direction of the heater 113) is described. With regard to a region of the heater 113 overlapping the heat conducting member 140 in the longitudinal direction of the heater 113, the pressure force causes the second surface 113*b* of the heater 113 to contact the heater contact portion 140*a* of the heat conducting member 140. Moreover, a surface of the heater contact portion 140*a* of the heat conducting member 140 facing the heater holder 130 is caused to contact the supporting surface 130*f* of the heater holder 130 facing that surface, so that the position of the heater 113 is determined.

Figure 10A:
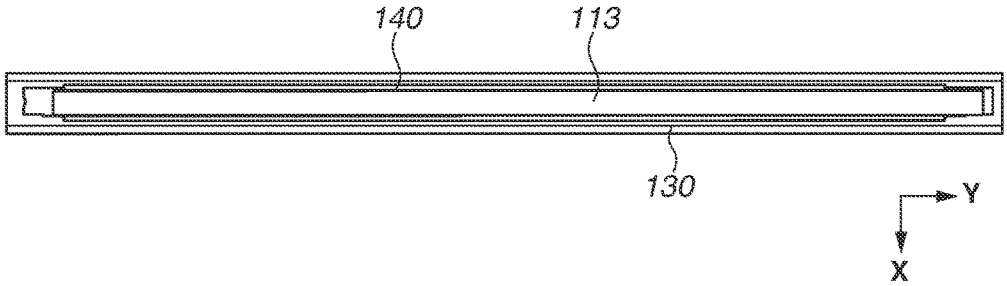
FIGS. 10A, 10B, and 10C are diagrams as viewed from the direction of arrow A illustrated in FIG. 6 in the third exemplary embodiment.
Figure 10B:
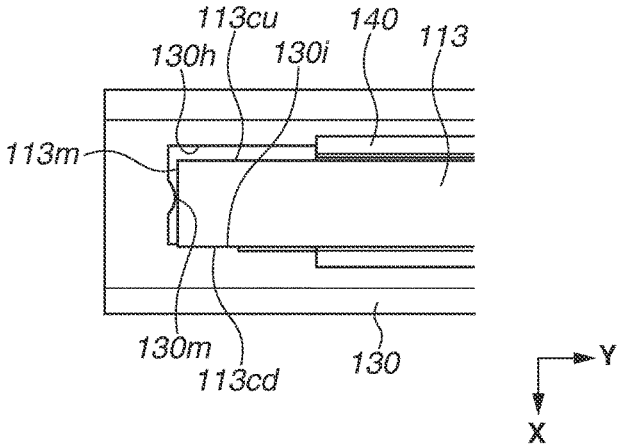
Figure 10C:
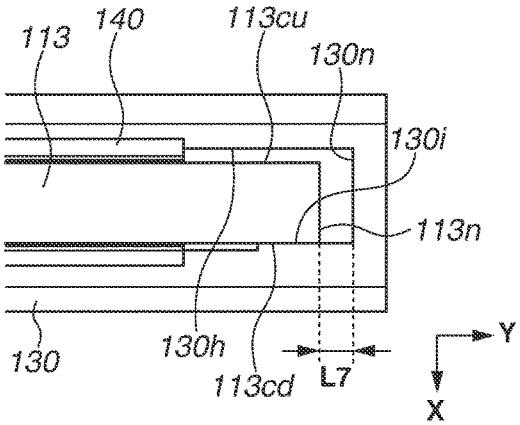

Next, the positioning configuration with respect to the Y-axis direction is described with reference to FIGS. 10A, 10B, and 10C. FIG. 10A is a diagram as viewed from the direction of arrow A in FIG. 9, and FIGS. 10B and 10C are enlarged views of respective portions near both longitudinal end portions in FIG. 10A. The heater 113 is pressed in a state in which one longitudinal end surface 113*m* of the heater 113 contacts an arc surface 130*m* provided on the groove portion of the heater holder 130, so that the position in the longitudinal direction of the heater 113 is determined. In this instance, a clearance L7 is provided between the other longitudinal end surface 113*n* of the heater 113 and a surface 130*n* provided on the groove portion of the heater holder 130 facing each other.

With these clearances L5 to L7 provided, even when the heater 113 generates heat, members different in linear expansion coefficient can be prevented from interfering with each other and becoming deformed.

With the above-described configuration, an advantageous effect can be achieved in which, for example, the deformation of the heat conducting member 140 caused by thermal expansion or contraction of each member is prevented or reduced and the position of the heat conducting member 140 relative to the heater holder 130 becomes stable.

Next, a fourth exemplary embodiment of the present disclosure is described. Members similar to those in the third exemplary embodiment are assigned the respective same reference characters, and are omitted from description.

Figure 11:
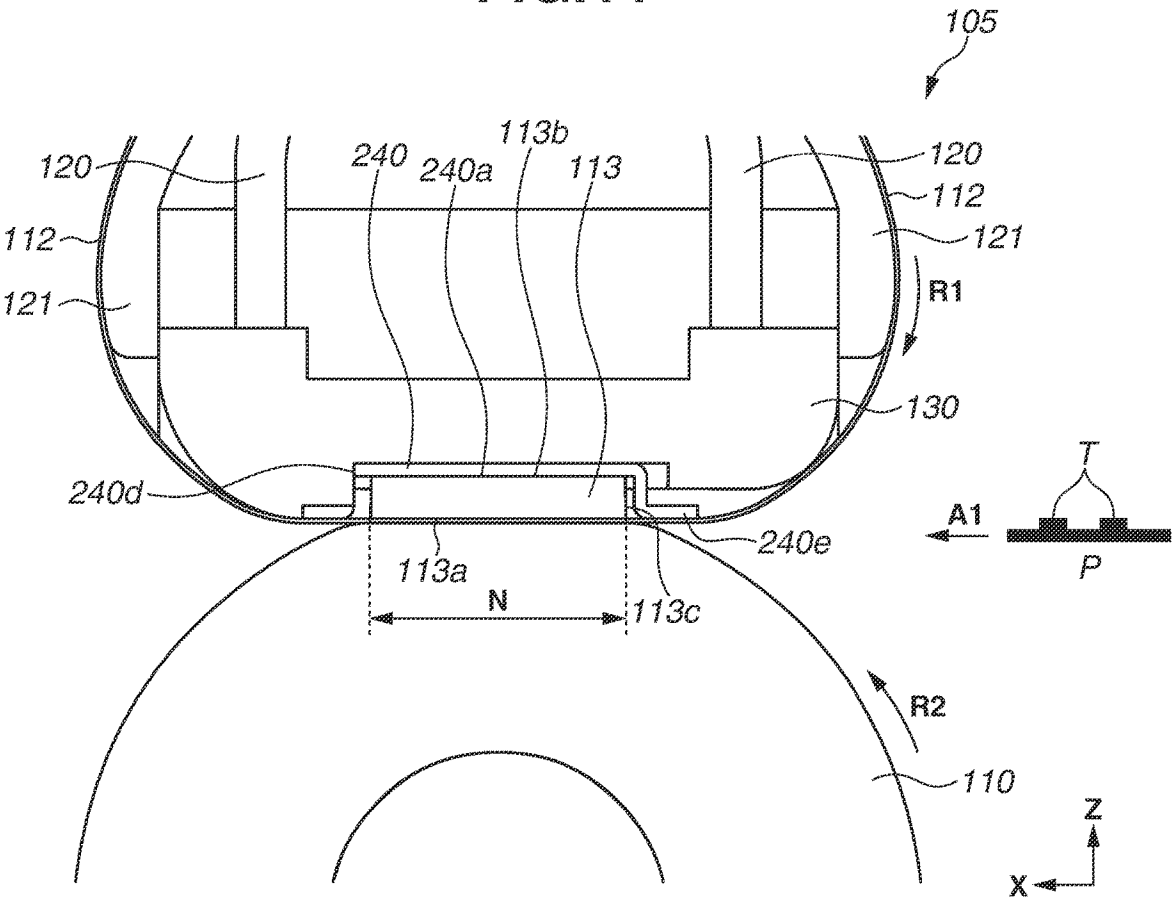
FIG. 11 is a sectional view of a fixing device according to a fourth exemplary embodiment.

First, a fixing device 100 according to the present exemplary embodiment is described with reference to FIG. 11. FIG. 11 is a sectional view taken perpendicular to the longitudinal direction of the heater 113 of the fixing device 100. A heat conducting member 240 in the present exemplary embodiment receives heat at a heater contact portion 240*a*, which contacts the second surface 113*b* of the heater 113 generating heat, and transfers the heat to the inner surface of the fixing film 112 via an upstream-side extension portion 240*e*, as with the third exemplary embodiment. In the present exemplary embodiment, the downstream-side extension portion 140*d*, which is included in the heat conducting member 140 in the third exemplary embodiment, is not provided.

Next, a positioning configuration of the heat conducting member 240 relative to the heater holder 130 is described with reference to FIG. 12 to FIGS. 13A and 13B.

Figure 12:
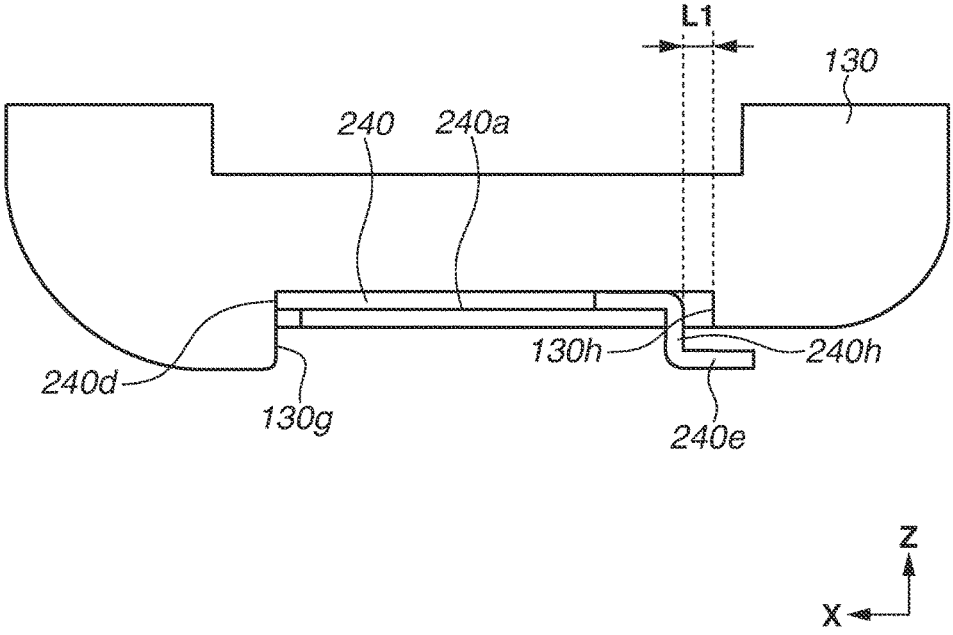
FIG. 12 is a sectional view of a heater holder and a heat conducting member according to the fourth exemplary embodiment.

First, positioning concerning two components, i.e., the heat conducting member 240 and the heater holder 130, in the X-axis direction (the rotation direction of the fixing film 112) is described with reference to FIG. 12. FIG. 12 is a sectional view illustrating only the above-mentioned two components.

The heat conducting member 240 is provided in such a manner that a part of the heat conducting member 240 is fitted between a wall surface 130*g* at the downstream side and a wall surface 130*h* at the upstream side in the recording material conveyance direction of a groove portion provided along the longitudinal direction of the heater holder 130. Here, a downstream-side end surface 240*d* of the heat conducting member 240 contacts the wall surface 130*g* of the heater holder 130, so that the position of the heat conducting member 240 relative to the heater holder 130 in the X-axis direction is determined. Here, a portion located between the heater contact portion 240*a* and the upstream-side extension portion 240*e* of the heat conducting member 240 and extending along the −Z-axis direction (along the third surface 113*c* of the heater 113) is referred to as a "bent portion 240*h*". A clearance L1 is provided between the bent portion 240*h* of the heat conducting member 240 and the wall surface 130*h* of the heater holder 130, so that a void space is formed.

Furthermore, a configuration in which the wall surface 130*h* and the bent portion 240*h* are in contact with each other to determine the position in the X-axis direction of the heat conducting member 240 and a clearance L1 is provided between the downstream-side end surface 240*d* of the heat conducting member 240 and the wall surface 130*g* of the heater holder 130 can be employed. Moreover, a configuration in which clearances are respectively provided between the wall surface 130*h* of the heater holder 130 and the bent portion 240*h* of the heat conducting member 240 and between the downstream-side end surface 240*d* and the wall surface 130*g* of the heater holder 130 can be employed.

Positioning concerning the Z-axis direction (the thickness direction of the heater 113) is similar to that in the third exemplary embodiment, and is, therefore, omitted from description.

Figure 13A:
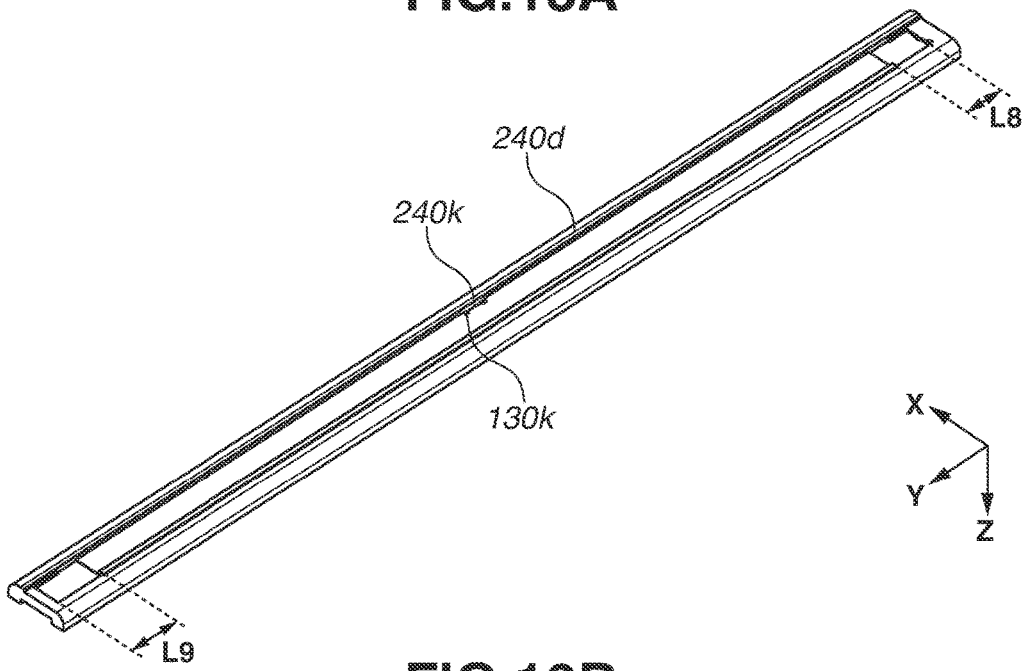
FIGS. 13A and 13B are perspective views of the heater holder and the heat conducting member according to the fourth exemplary embodiment.

Next, a positioning configuration concerning the Y-axis direction (the longitudinal direction of the heater 113) is described with reference to FIGS. 13A and 13B. FIG. 13A is a perspective view illustrating only two components, i.e., the heater holder 130 and the heat conducting member 240, and FIG. 13B is a perspective view illustrating the above-mentioned two components in a separate manner for convenience sake.

Figure 13B:
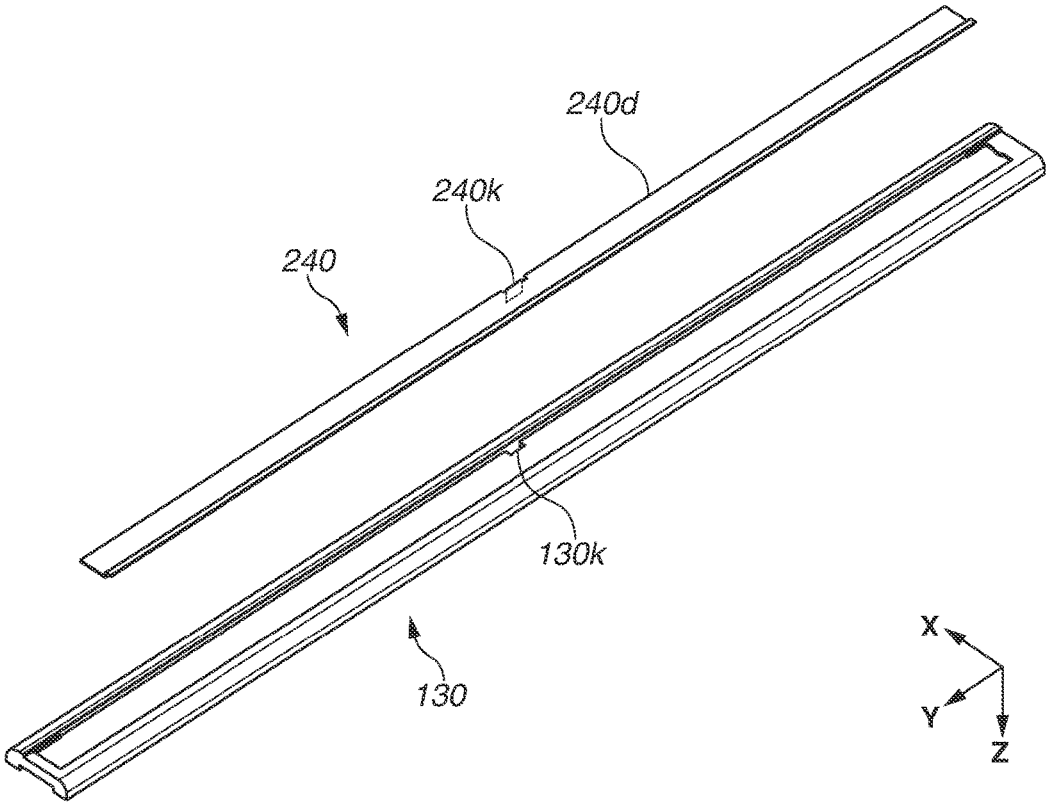

As illustrated in FIGS. 13A and 13B, a bent portion 240*k* of the heat conducting member 240 is inserted into a hole portion 130*k* provided on the heater holder 130 in such a manner that the bent portion 240*k* engages with the hole portion 130*k*, so that the position of the heat conducting member 240 relative to the heater holder 130 is determined. In this instance, the bent portion 240*k* provided on the heat conducting member 240 is formed by bending and raising a part of the downstream-side end surface 240*d* of the heat conducting member 240 in a direction to come close to the heater holder 130. Moreover, the bent portion 240*k* is provided near the middle portion of the heat conducting member 240 with respect to the Y-axis direction. Furthermore, as illustrated in FIG. 13A, a clearance L8 is provided between one longitudinal end surface of the heat conducting member 240 and one longitudinal end surface of the groove portion of the heater holder 130 facing each other. A clearance L9 is provided between the other longitudinal end surface of the heat conducting member 240 and the other longitudinal end surface of the groove portion of the heater holder 130 facing each other. With these clearances L8 and L9 provided, even when the heater 113 generates heat, members different in linear expansion coefficient can be prevented from interfering with each other and becoming deformed.

With the above-described configuration, an advantageous effect can be achieved in which, for example, the deformation of the heat conducting member 240 caused by thermal expansion or contraction of each member is prevented or reduced and the position of the heat conducting member 240 becomes stable.

Figure 14:
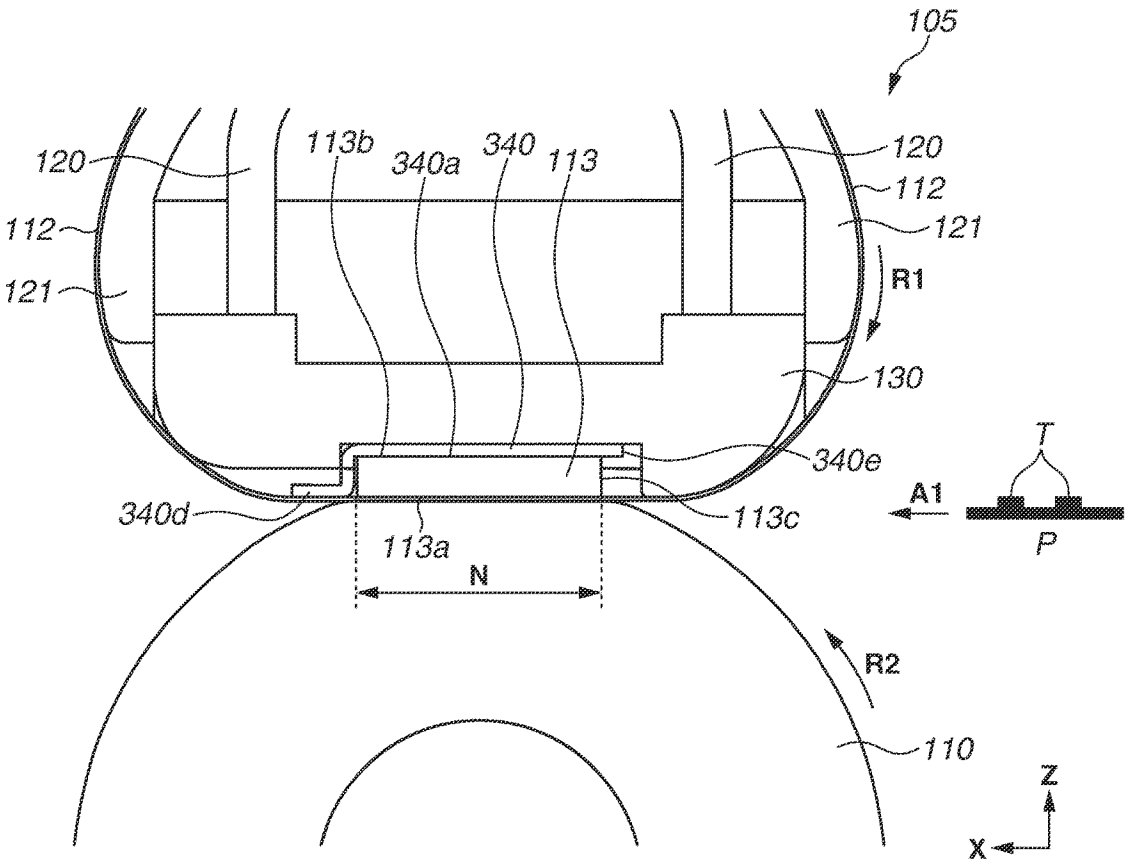
FIG. 14 is a sectional view of a fixing device according to a fifth exemplary embodiment.

Next, a fifth exemplary embodiment of the present disclosure is described. Members similar to those in the third exemplary embodiment are omitted from description. First, a fixing device 100 according to the present exemplary embodiment is described with reference to FIG. 14. FIG. 14 is a schematic sectional view taken perpendicular to the longitudinal direction of the heater 113 of the fixing device 100. A heat conducting member 340 in the present exemplary embodiment receives heat of the heater 113 at a heater contact portion 340*a*, which contacts the second surface 113*b* of the heater 113, and transfers the heat to the inner surface of the fixing film 112 via a downstream-side extension portion 340*d*, as with the third exemplary embodiment. In the heat conducting member 340, the upstream-side extension portion 140*e*, which is included in the heat conducting member 140 in the third exemplary embodiment, is not provided.

Next, a positioning configuration of the heat conducting member 340 relative to the heater holder 130 concerning the X-axis direction is described with reference to FIG. 15 to FIGS. 16A and 16B.

Figure 15:
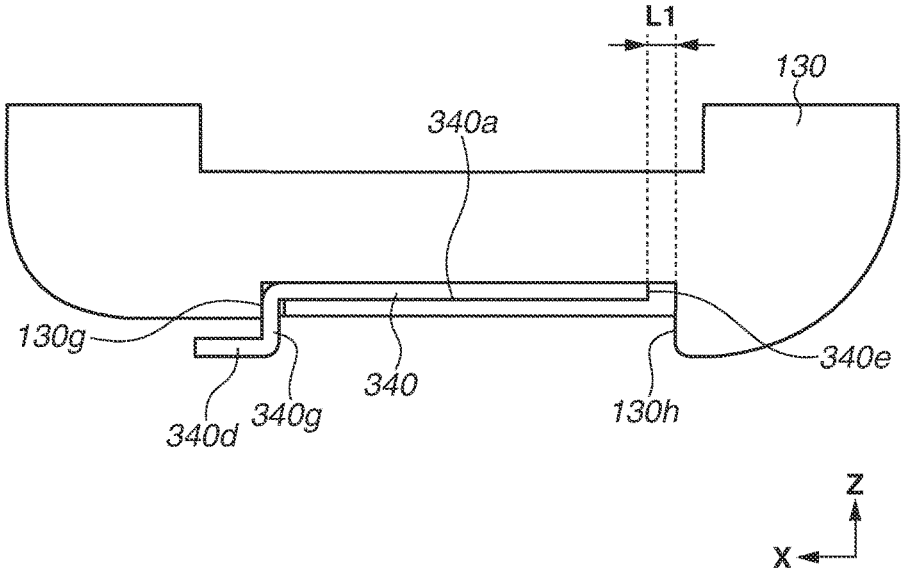
FIG. 15 is a sectional view of a heater holder and a heat conducting member according to the fifth exemplary embodiment.

First, positioning of the heat conducting member 340 concerning two components, i.e., the heat conducting member 340 and the heater holder 130, in the X-axis direction is described. FIG. 15 is a sectional view illustrating only the above-mentioned two components.

The heat conducting member 340 is provided in such a manner that a part of the heat conducting member 340 is fitted between a wall surface 130*g* at the downstream side and a wall surface 130*h* at the upstream side in the recording material conveyance direction of a groove portion provided along the longitudinal direction of the heater holder 130. Here, a portion located between the heater contact portion 340*a* and the downstream-side extension portion 340*d* of the heat conducting member 340 and extending along the −Z-axis direction (along the third surface 113*c* of the heater 113) is referred to as a "bent portion 340*g*". The bent portion 340*g* of the heat conducting member 340 contacts the wall surface 130*g* of the heater holder 130, so that the position of the heat conducting member 340 relative to the heater holder 130 in the X-axis direction is determined. Then, a clearance L1 is provided between the upstream-side end portion 340*e* of the heat conducting member 340 and the wall surface 130*h* of the heater holder 130, so that a void space is formed.

Furthermore, a configuration in which the wall surface 130*h* and the upstream-side end portion 340*e* are in contact with each other to determine the position in the X-axis direction of the heat conducting member 340 and a clearance L1 is provided between the bent portion 340*g* of the heat conducting member 340 and the wall surface 130*g* of the heater holder 130 can be employed. Moreover, a configuration in which clearances are respectively provided between the wall surface 130*h* of the heater holder 130 and the upstream-side end portion 340*e* of the heat conducting member 340 and between the bent portion 340*g* and the wall surface 130*g* of the heater holder 130 can be employed.

Positioning concerning the Z-axis direction (the thickness direction of the heater 113) is similar to that in the third exemplary embodiment, and is, therefore, omitted from description.

Figure 16A:
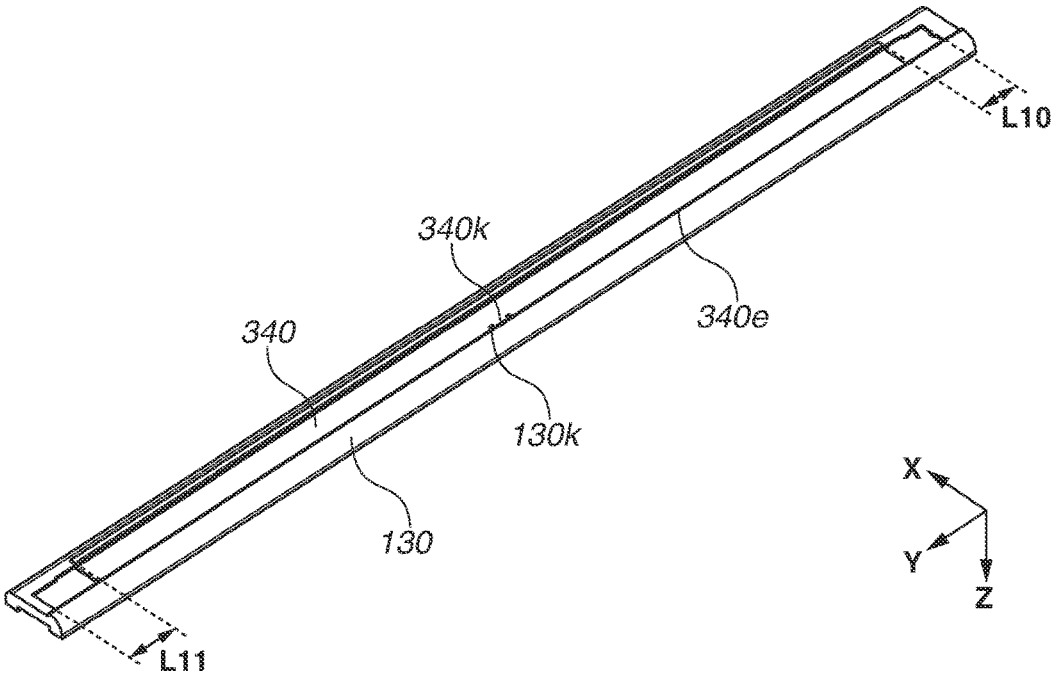
FIGS. 16A and 16B are perspective views of the heater holder and the heat conducting member according to the fifth exemplary embodiment.

Next, a positioning configuration concerning the Y-axis direction (the longitudinal direction of the heater 113) is described with reference to FIGS. 16A and 16B. FIG. 16A is a perspective view illustrating only two components, i.e., the heater holder 130 and the heat conducting member 340, and FIG. 16B is a perspective view illustrating the above-mentioned two components in a separate manner for convenience sake.

Figure 16B:
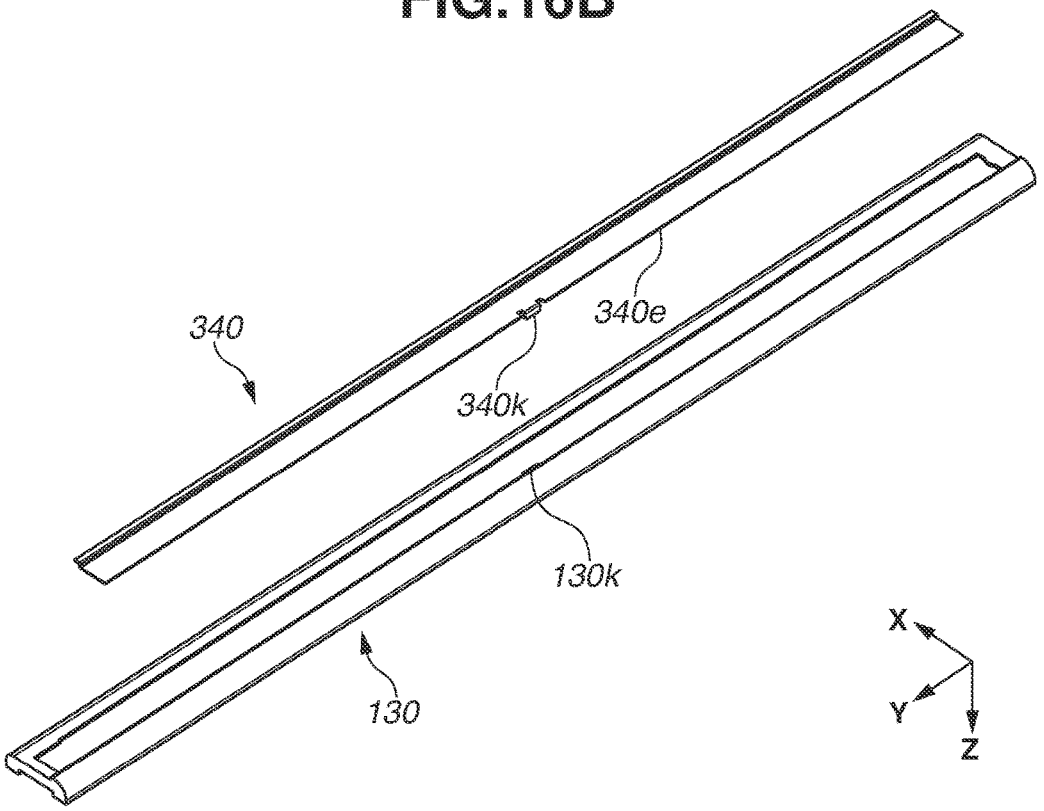

As illustrated in FIGS. 16A and 16B, a bent portion 340*k* of the heat conducting member 340 is inserted into a hole portion 130*k* provided on the heater holder 130 in such a manner that the bent portion 340*k* engages with the hole portion 130*k*, so that the position of the heat conducting member 340 relative to the heater holder 130 is determined. In this instance, the bent portion 340*k* provided on the heat conducting member 340 is formed by bending and raising a part of the upstream-side end portion 340*e* of the heat conducting member 340 in a direction to come close to the heater holder 130. Moreover, the bent portion 340*k* is provided near the middle portion of the heat conducting member 340 with respect to the Y-axis direction. Furthermore, as illustrated in FIG. 16A, a clearance L10 is provided between one longitudinal end surface of the heat conducting member 340 and one longitudinal end surface of the groove portion of the heater holder 130 facing each other. A clearance L11 is provided between the other longitudinal end surface of the heat conducting member 340 and the other longitudinal end surface of the groove portion of the heater holder 130 facing each other. With these clearances L10 and L11 provided, even when the heater 113 generates heat, members different in linear expansion coefficient can be prevented from interfering with each other and becoming deformed.

With the above-described configuration, an advantageous effect can be achieved in which, for example, the deformation of the heat conducting member 340 caused by thermal expansion or contraction of each member is prevented or reduced and the position of the heat conducting member 340 becomes stable.

Furthermore, the heat conducting member in each of the first to fifth exemplary embodiments is provided to extend over a sheet passing region and a sheet non-passing region for a small-sized recording material of the heater in the longitudinal direction of the heater. This configuration is employed to prevent or reduce a temperature rise of the sheet non-passing region which would be caused when fixing processing is continuously performed on the small-sized recording material.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-128000 filed Jun. 29, 2017, which is hereby incorporated by reference herein in its entirety.

What is claimed is:

1. A fixing device that heats a toner image to fix the toner image to a recording material, the fixing device comprising:

a rotatable cylindrical film;

an elongated plate-like heater which has a first surface, and a second surface opposite to the first surface and which contacts an inner surface of the film with the first surface;

a heat conducting member which extends in a longitudinal direction of the heater and which includes a heater contact portion contacting the second surface of the heater; and a supporting member which supports the second surface of the heater via the heat conducting member, wherein the heat conducting member includes a heater contact portion which is sandwiched between the heater and the supporting member, and an extension portion which extends from the heater contact portion, wherein the extension portion comprises a first portion, extending in a thickness direction of the heater, which connects to the heater contact portion and a second portion, extending in the rotation direction of the film or a direction opposite to the rotation direction, which connects to the first portion, wherein the supporting member includes a facing portion which faces the second portion in the thickness direction, and wherein a void space is provided between the second portion of the heat conducting member and the facing portion of the supporting member.

2. The fixing device according to claim 1, wherein the extension portion is an upstream-side extension portion which extends along the direction opposite to the rotation direction of the film from the heater contact portion, and wherein the facing portion is an upstream-side facing portion which faces the upstream-side extension portion in the thickness direction.

3. The fixing device according to claim 2, wherein the heat conducting member includes a downstream-side extension portion which extends along the rotation direction of the film from the heater contact portion and which contacts the inner surface of the film, wherein the supporting member includes a downstream-side facing portion which faces the downstream-side extension portion in the thickness direction, and wherein a void space is provided between the downstream-side extension portion of the heat conducting member and the downstream-side facing portion of the supporting member.

4. The fixing device according to claim 1, wherein the extension portion is a downstream-side extension portion which extends along the rotation direction of the film from the heater contact portion, and wherein the facing portion is a downstream-side facing portion which faces the downstream-side extension portion in the thickness direction of the heater.

5. The fixing device according to claim 1, further comprising a roller which forms a nip portion in conjunction with the heater via the film.

6. The fixing device according to claim 1, wherein the facing portion of the supporting member is provided with a protruded portion extending toward the second portion of the heat conducting member.

7. The fixing device according to claim 1, wherein the heat conducting member is provided with the void space between the second portion of the heat conducting member and the facing portion of the supporting member at an end portion in the longitudinal direction of the heater.

8. The fixing device according to claim 1, wherein the heat conducting member is provided with void spaces between the second portion of the heat conducting member and the facing portion of the supporting member at respective both end portions in the longitudinal direction of the heater.

9. The fixing device according to claim 1, wherein teh second portion is configured to contact the film.

* * * * *